US010314113B2

(12) United States Patent
Russegger et al.

(10) Patent No.: US 10,314,113 B2
(45) Date of Patent: Jun. 4, 2019

(54) LAYERED HEATER SYSTEM HAVING CONDUCTIVE OVERLAYS

(71) Applicant: Watlow Electric Manufacturing Company, St. Louis, MO (US)

(72) Inventors: Elias Russegger, Golling (AT); Gerhard Schefbanker, Scheffau am Tennengebirge (AT); Martin Wallinger, Abtenau (AT); Kevin Ptasienski, Fenton, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 750 days.

(21) Appl. No.: 14/714,417

(22) Filed: May 18, 2015

(65) Prior Publication Data

US 2015/0250026 A1 Sep. 3, 2015

Related U.S. Application Data

(63) Continuation of application No. 11/780,825, filed on Jul. 20, 2007, now abandoned.

(60) Provisional application No. 60/832,053, filed on Jul. 20, 2006.

(51) Int. Cl.

| | |
|---|---|
| ***H05B 3/26*** | (2006.01) |
| ***H01C 17/242*** | (2006.01) |
| ***H01C 17/10*** | (2006.01) |

(52) U.S. Cl.

CPC ..... *H05B 3/26* (2013.01); *H01C 17/10* (2013.01); *H01C 17/242* (2013.01); *H05B 2203/002* (2013.01); *H05B 2203/003* (2013.01); *H05B 2203/01* (2013.01); *H05B 2203/013* (2013.01); *H05B 2203/017* (2013.01); *Y10T 29/49083* (2015.01)

(58) Field of Classification Search

CPC ..... H05B 2203/001; H05B 2203/002; H05B 2203/003; H05B 2203/013; H05B 2203/017; H05B 3/26; H01C 17/10; H01C 17/242; Y10T 29/49083

USPC .... 219/549, 535, 538, 543, 552, 424, 444.1; 29/611, 620

See application file for complete search history.

(56) References Cited

U.S. PATENT DOCUMENTS

| | | | | |
|---|---|---|---|---|
| 2005/0145617 A1* | 7/2005 | McMillin | ..... | H05B 3/28 219/543 |
| 2005/0199610 A1* | 9/2005 | Ptasienski | ..... | H05B 3/26 219/543 |

FOREIGN PATENT DOCUMENTS

| | | |
|---|---|---|
| JP | 2000275078 | 10/2000 |
| JP | 2001126847 | 5/2001 |

* cited by examiner

*Primary Examiner* — Dana Ross
*Assistant Examiner* — James F Sims, III
(74) *Attorney, Agent, or Firm* — Burris Law, PLLC

(57) ABSTRACT

A layered heater includes a resistive layer defining a resistive circuit pattern having at least one bend portion. A conductive overlay is provided on at least one of a top surface and a bottom surface of the bend portion to alleviate the current crowding effect, thereby protecting the electric circuit from premature failure. Methods of manufacturing the layered heater are also disclosed. The overlay may be formed on the bend portion after the resistive layer is formed. The overlay may also be formed on a substrate or a dielectric layer that supports the resistive layer before the resistive layer is formed.

11 Claims, 20 Drawing Sheets

LAYERED HEATER SYSTEM HAVING CONDUCTIVE OVERLAYS

CROSS-REFERENCE TO RELATED APPLICATION

This application is a continuation of U.S. patent application Ser. No. 11/780,825, filed Jul. 20, 2007, which claims the benefit of U.S. Provisional Application, Ser. No. 60/832,053, filed Jul. 20, 2006, and titled "Layered Heater System Having Conductive Overlays." The disclosures of the above applications are incorporated herein by reference.

FIELD

The present disclosure relates generally to electric heaters, and more particularly to layered heaters and related methods to reduce current crowding within curved portions of a resistive heating element trace.

BACKGROUND

The statements in this section merely provide background information related to the present disclosure and may not constitute prior art.

Layered heaters are typically used in applications where space is limited, when heat output needs vary across a surface, where rapid thermal response is desirous, or in ultra-clean applications where moisture or other contaminants can migrate into conventional heaters. A layered heater generally comprises layers of different materials, namely, a dielectric and a resistive material, which are applied to a substrate. The dielectric material is applied first to the substrate and provides electrical isolation between the substrate and the electrically-live resistive material and also reduces current leakage to ground during operation. The resistive material is applied to the dielectric material in a predetermined pattern and provides a resistive heater circuit. The layered heater also includes leads that connect the resistive heater circuit to an electrical power source, which is typically cycled by a temperature controller. The lead-to-resistive circuit interface is also typically protected both mechanically and electrically from extraneous contact by providing strain relief and electrical isolation through a protective layer. Accordingly, layered heaters are highly customizable for a variety of heating applications.

Layered heaters may be "thick" film, "thin" film, or "thermally sprayed," among others, wherein the primary difference between these types of layered heaters is the method in which the layers are formed. For example, the layers for thick film heaters are typically formed using processes such as screen printing, decal application, or film dispensing heads, among others. The layers for thin film heaters are typically formed using deposition processes such as ion plating, sputtering, chemical vapor deposition (CVD), and physical vapor deposition (PVD), among others. Yet another series of processes distinct from thin and thick film techniques are those known as thermal spraying processes, which may include by way of example flame spraying, plasma spraying, wire arc spraying, and HVOF (High Velocity Oxygen Fuel), among others.

The resistive heating layer in these layered heaters is generally formed as a pattern or a trace with curved or bend portions, e.g. non-linear, where current crowding often occurs. Generally, current crowding refers to a non-uniform distribution of current density where the current tends to build up or increase near geometric features that present obstacles to a smooth current flow, i.e. bend portions. In operation, as the current travels around a bend portion, the current exhibits a tendency to build up, or crowd, around the inner portion of the curve as it makes its way around the bend portion. Due to this current crowding effect, the bend portions are susceptible to an increased current density, causing burning, which can lead to premature failure of the resistive heating layer and thus the overall heater system.

SUMMARY

In one preferred form, a layered heater is provided that comprises a resistive layer having a resistive circuit pattern. The resistive circuit pattern defines at least one bend portion having a top surface and a bottom surface. A conductive overlay is provided on at least one of the top surface and the bottom surface of the bend portion to reduce current crowding.

In another form, a method of manufacturing a layered heater is provided. The method comprises forming a resistive layer having a circuit pattern with at least one bend portion, followed by forming a conductive overlay on the bend portion.

In still another form, a second method of manufacturing a layered heater is provided. The method comprises forming a conductive overlay where a bend portion of a circuit pattern of a resistive layer is to be formed, and forming the resistive layer having the circuit pattern with the bend portion on the overlay.

In an alternate form of the present disclosure, the overlay is formed both below and above the resistive layer proximate the bend portion. Optionally, dielectric layers may be formed between a substrate and the resistive layer and over the resistive layer, if required.

Additionally, another method of forming a layered heater is provided that comprises forming a continuous resistive layer over a substrate, forming conductive overlays in predetermined areas of the resistive layer, and removing portions of the continuous resistive layer between the conductive overlays to form a plurality of single cuts extending between the conductive overlays. The single cuts extend through the continuous resistive layer between the conductive overlays and longitudinally into a portion of the corresponding conductive overlays. Preferably, the single cuts are formed using a laser.

In yet another method, a layered heater is created by forming a continuous resistive layer over a substrate, forming conductive overlays in predetermined areas of the resistive layer, and removing portions of the continuous resistive layer between the conductive overlays to form a plurality of parallel cuts extending between and around the conductive overlays. The parallel cuts extend through the continuous resistive layer and do not extend into any portion of the conductive overlays. Preferably, the parallel cuts are formed using a laser.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
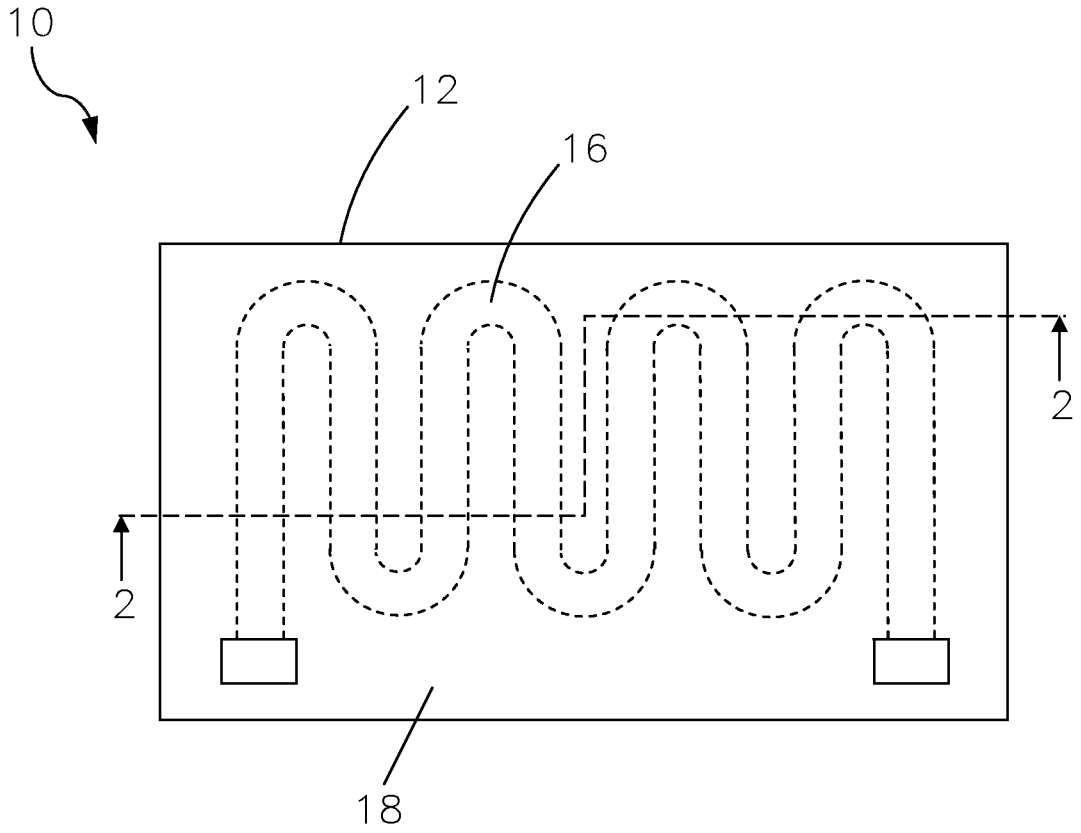
FIG. 1 (Prior Art)
FIG. 1 is a plan view of a layered heater with a resistive circuit pattern in accordance with a prior art layered heater.
Figure 2:
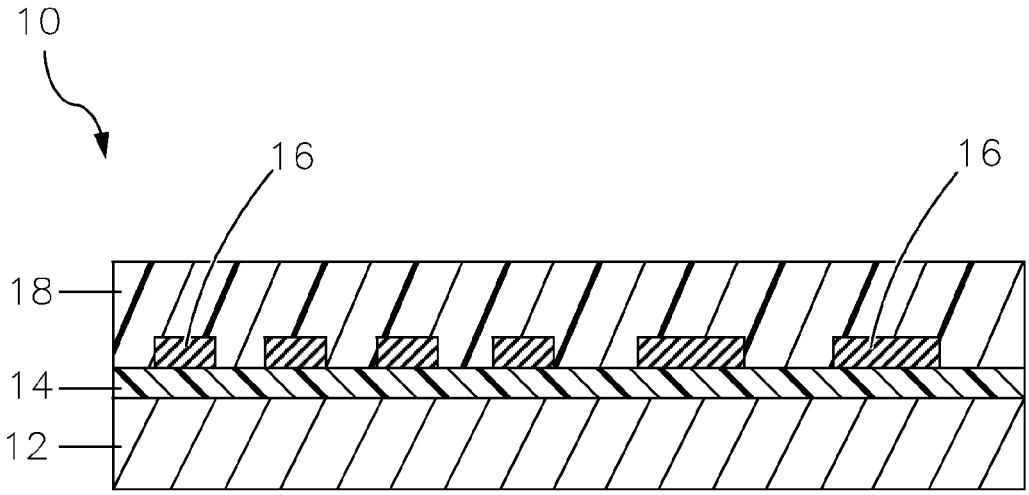
FIG. 2 PRIOR ART
FIG. 2 is a cross-sectional view, taken along line 2-2 of FIG. 1 of a layered heater in accordance with a prior art layered heater.

Referring to FIGS. 1 and 2, a prior art layered heater 10 is illustrated that includes a substrate 12, a first dielectric layer 14, a resistive layer 16 defining a resistive circuit pattern formed on the first dielectric layer 14, and a second dielectric layer 18 formed over the resistive layer 16. Generally, the resistive circuit pattern is shown to have a serpentine pattern and has a uniform thickness throughout the resistive layer 16.

Figure 3:
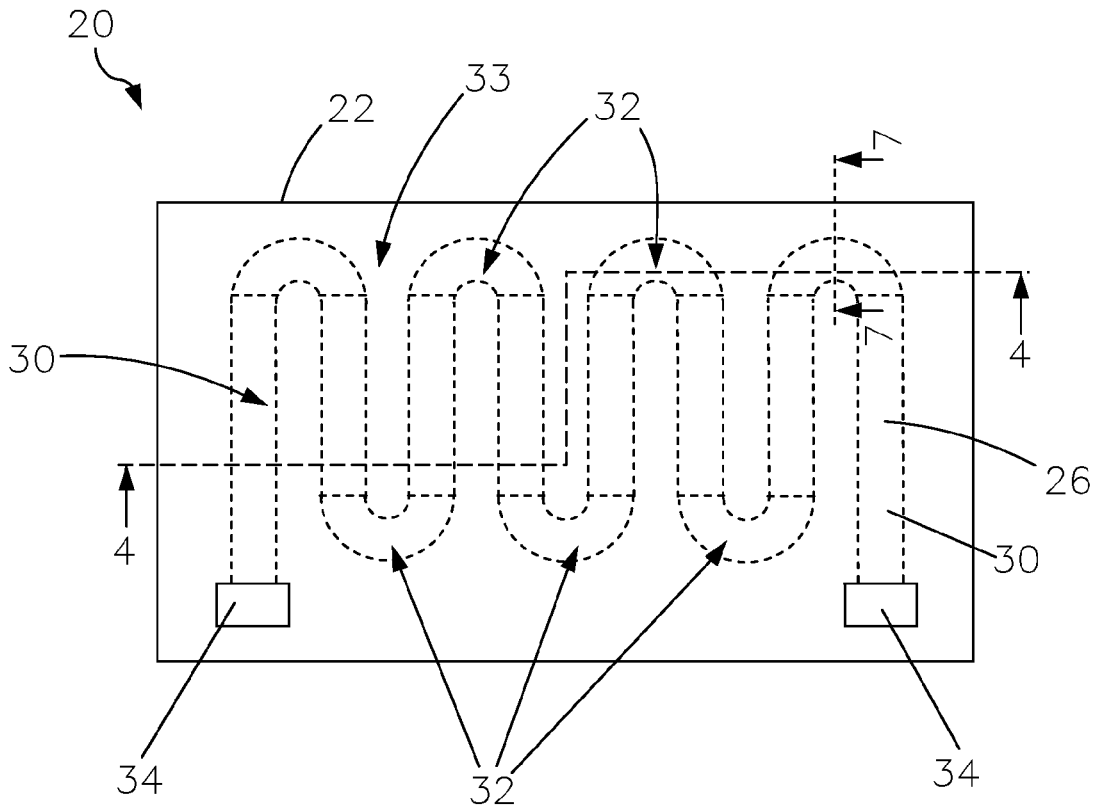
FIG. 3 is a plan view of a layered heater with a resistive circuit pattern constructed in accordance with the principles of the present disclosure.
Figure 4:
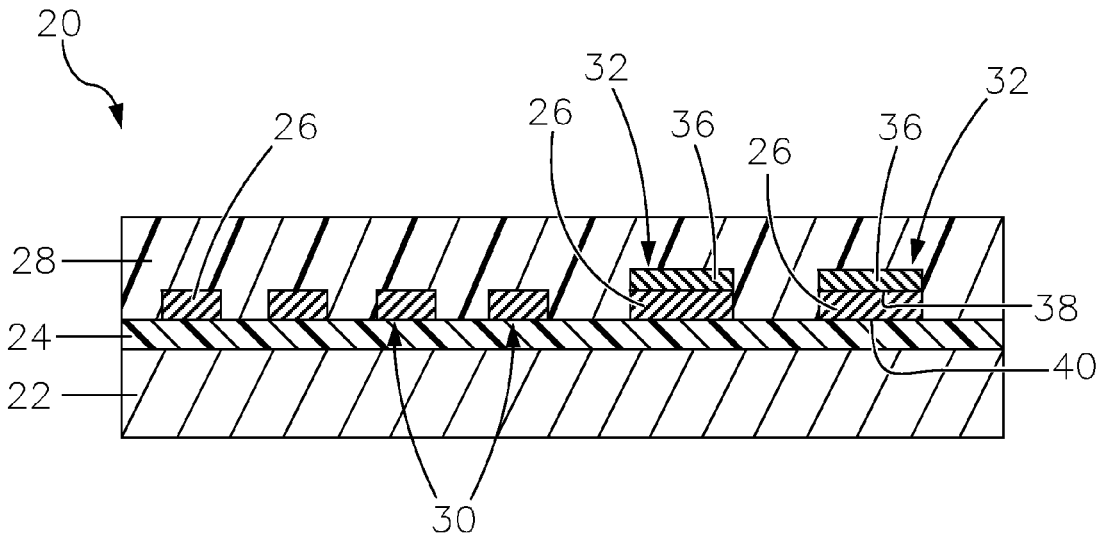
FIG. 4 is a cross-sectional view, taken along line 4-4 of FIG. 3 of a layered heater with a resistive circuit pattern in accordance with the principles of the present disclosure.

Referring now to FIGS. 3 and 4, a layered heater in accordance with the present disclosure is illustrated and generally indicated by reference numeral 20. The layered heater 20 comprises a substrate 22, a first dielectric layer 24 formed over the substrate 22, a resistive layer 26 formed over the first dielectric layer 24, and a second dielectric layer 28 formed over the resistive layer 26 and the first dielectric layer 24. The resistive layer 26 is preferably made of a conductive material of high resistance sufficient to function as a resistive heating element. In this illustrative embodiment, the resistive layer 26 defines a serpentine pattern as shown and includes a plurality of straight portions 30 connected by a plurality of bend portions 32 to complete a circuit pattern 33. The circuit pattern 33 has each of its ends connected to a pair of terminal pads 34, which connect the resistive layer 26 to a power source (not shown) to complete an electric circuit, thus providing power to operate the layered heater 20.

To reduce the effect of current crowding, (as described above in the Background section), a plurality of overlays 36 (FIG. 4) are provided proximate the bend portions 32 to provide additional resistance to the electric current passing around the bend portions 32. With the increased resistance around the bend portions 32, the increased current density due to crowding is distributed throughout both the bend portions 32 of the circuit and the overlays 36, which increases the life of the layered heater 20.

Figure 5:
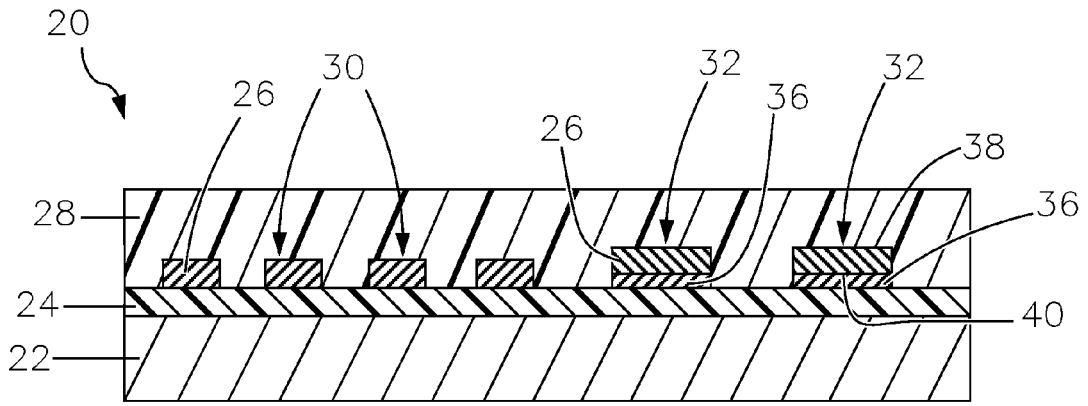
FIG. 5 is a cross-sectional view, similar to FIG. 4, showing overlays on a bottom surface of a bend portion of a resistive layer in accordance with an alternate form of the present disclosure.
Figure 6:
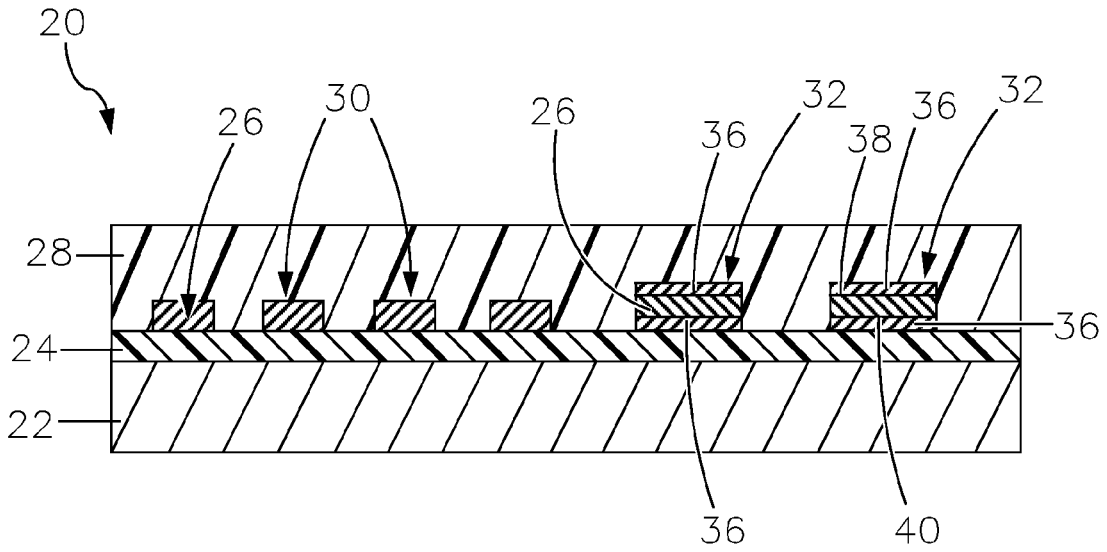
FIG. 6 is a cross-sectional view, similar to FIG. 4, showing overlays on both of a top surface and a bottom surface of a bend portion of a resistive layer in accordance with another alternate form of the present disclosure.

As shown, the bend portions 32 each have a top surface 38 and a bottom surface 40. The overlays 36 may be formed on the top surface 38 as shown in FIG. 4 or on the bottom surface 40 as shown in FIG. 5. Alternatively, the overlays 36 may be provided on both of the top surface 38 and the bottom surface 40 as shown in FIG. 6.

Figure 7:
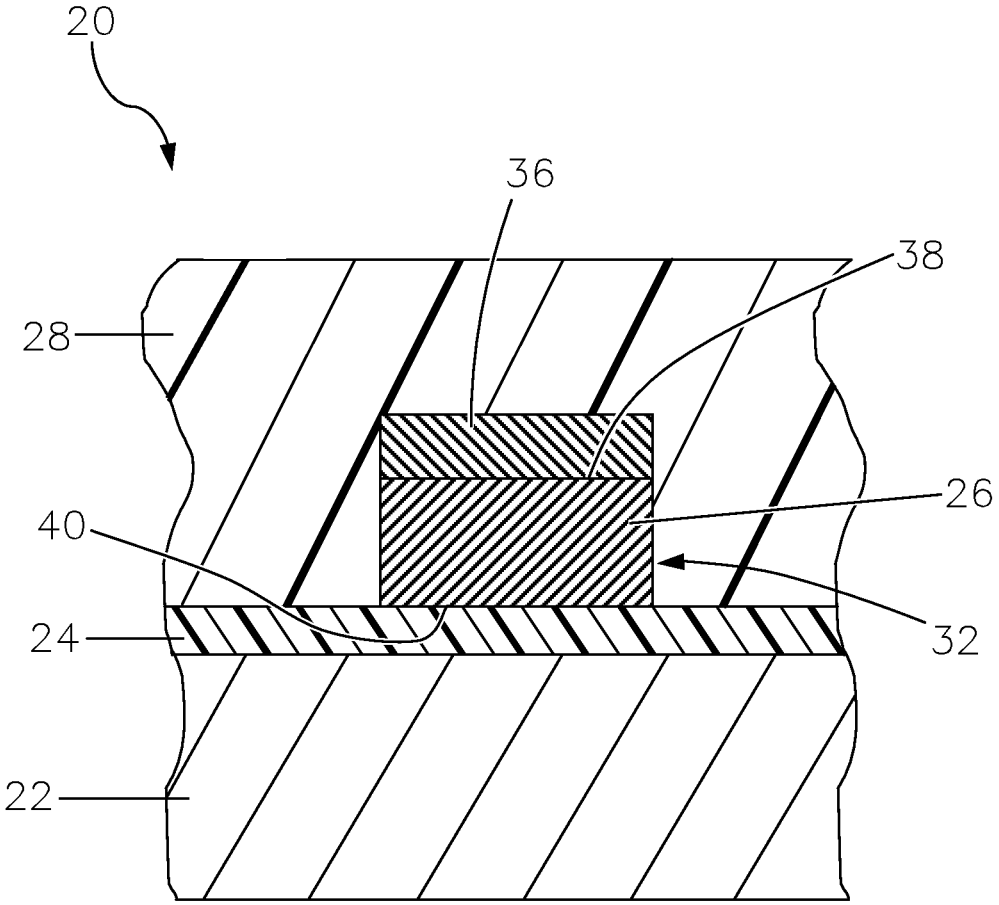
FIG. 7 is an enlarged cross-sectional view taken along line 7-7 of FIG. 3, showing a conductive overlay with a uniform thickness formed on a top surface of a bend portion of a resistive layer in accordance with the principles of the present disclosure.
Figure 8:
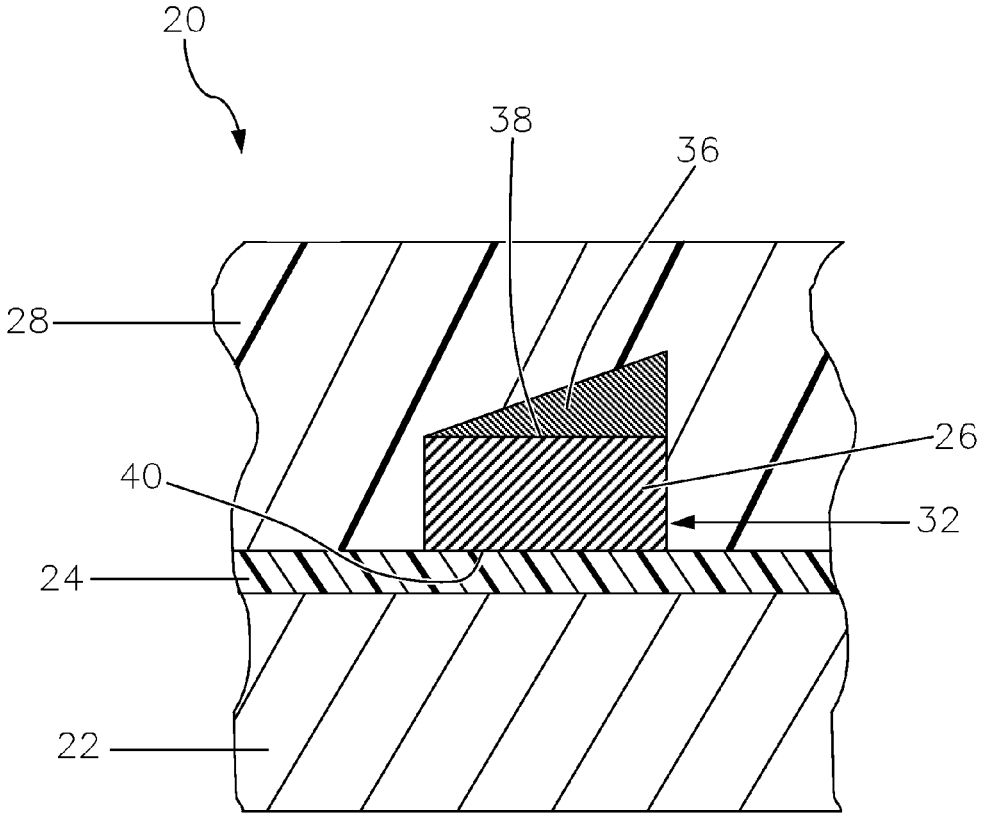
FIG. 8 is a view similar to FIG. 7, showing a conductive overlay defining a variable thickness across its width and formed on a top surface of a bend portion of a resistive layer and constructed in accordance with the principles of the present disclosure.

Referring to FIGS. 7 and 8, the overlay 36 may be formed to have a uniform thickness as shown in FIG. 7 or a variable thickness as shown in FIG. 8. Such variable thickness techniques are shown and described in U.S. Pat. No. 7,132,628 titled "Variable Watt Density Layered Heater," issued on Nov. 7, 2006, which is commonly assigned with the present application and the contents of which are incorporated herein by reference in their entirety.

In FIG. 8, the overlay 36 has the largest thickness at an area of the bend portion 32 which has the smallest radius of curvature. A conductive overlay 36 with variable thickness is more tailored to better accommodate the current crowding effect occurring within the bend portions 32 close to the smallest radius of curvature. Moreover, the overlays 36 on the plurality of the bend portions 32 do not have to have the same shape or size. Because the circuit pattern does not have to define a serpentine pattern and can be of any shape or size, the overlays 36 can be formed to have different size, thickness, and shape depending on the shape and size of the bend portions 32 and the extent of the current crowding effect.

Figure 9:
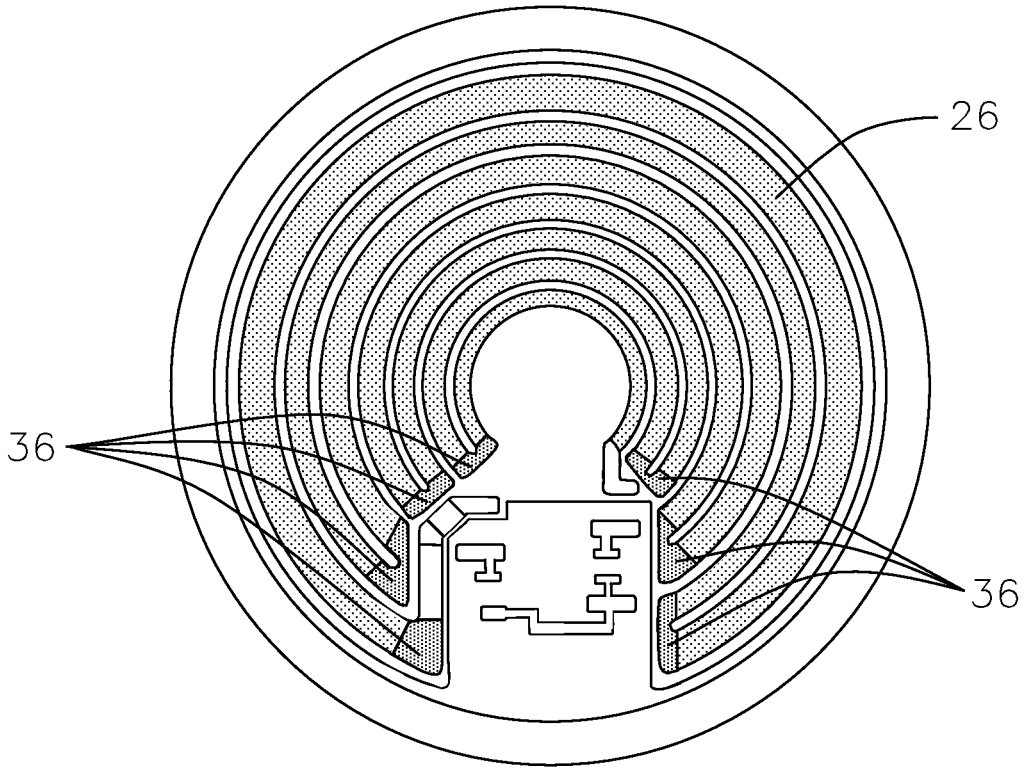
FIG. 9 is a plan view of a layered heater formed using a thermal spray process having conductive overlays disposed proximate areas where current crowding is likely to occur and constructed in accordance with the principles of the present disclosure.
Figure 10:
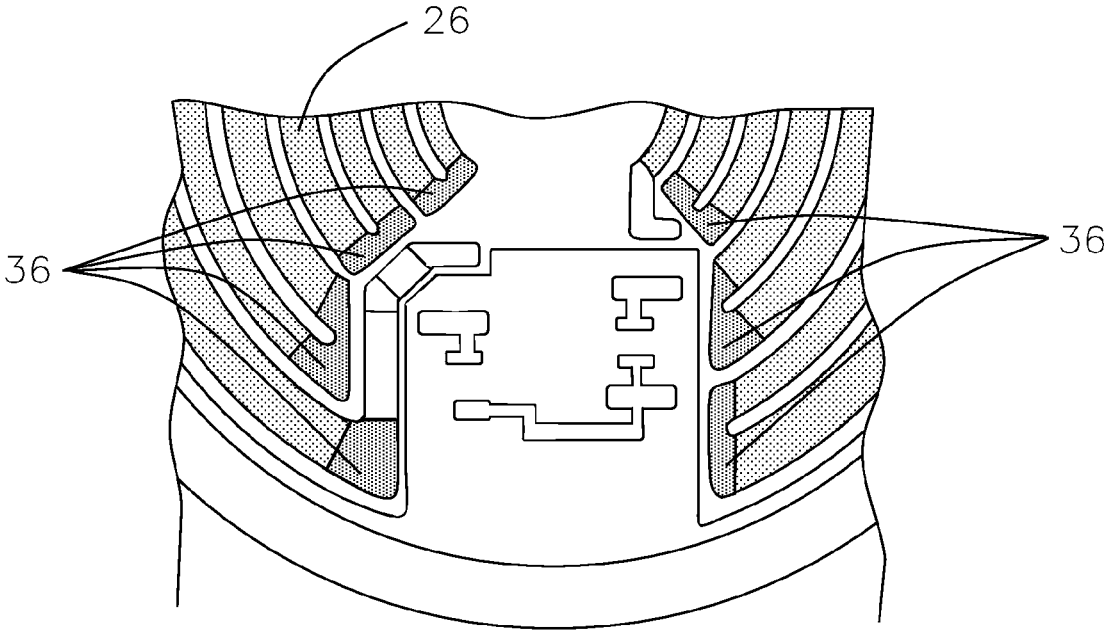
FIG. 10 is an enlarged detail view of the layered heater of FIG. 9 in accordance with the principles of the present disclosure.

Exemplary embodiments of such different sizes and shapes are illustrated in FIGS. 9 and 10. As shown, overlays 36 are disposed over select areas of the resistive layer 26, which has preferably been formed using a thermal spray process in accordance with one form of the present disclosure. The overlays 36 are disposed proximate areas that are susceptible to current crowding, which are generally areas where a sudden or abrupt change in the general direction of the circuit pattern of the resistive layer 26 occurs. In preliminary testing, layered heaters having the overlays 36 in accordance with the principles and teachings of the present disclosure have demonstrated an increase in life over layered heaters without any features to compensate for current crowding. It should be understood that the configurations of the layered heaters as illustrated herein are exemplary only and are not intended to limit the scope of the present disclosure.

It should also be noted that the overlays 36 may be made of the same material as, or different material from that of the resistive layer 26. In one form, the overlays 36 are made of a material having a higher resistance than the resistive layer 26, which includes approximately 30% Ag, approximately 38% Cu, and approximately 32% Zn. However, it should be understood that a variety of materials may be employed in accordance with the teachings of the present disclosure so long as the material provides additional resistance proximate areas of current crowding. Accordingly, the materials cited herein should not be construed as limiting the scope of the present disclosure.

Figure 11:
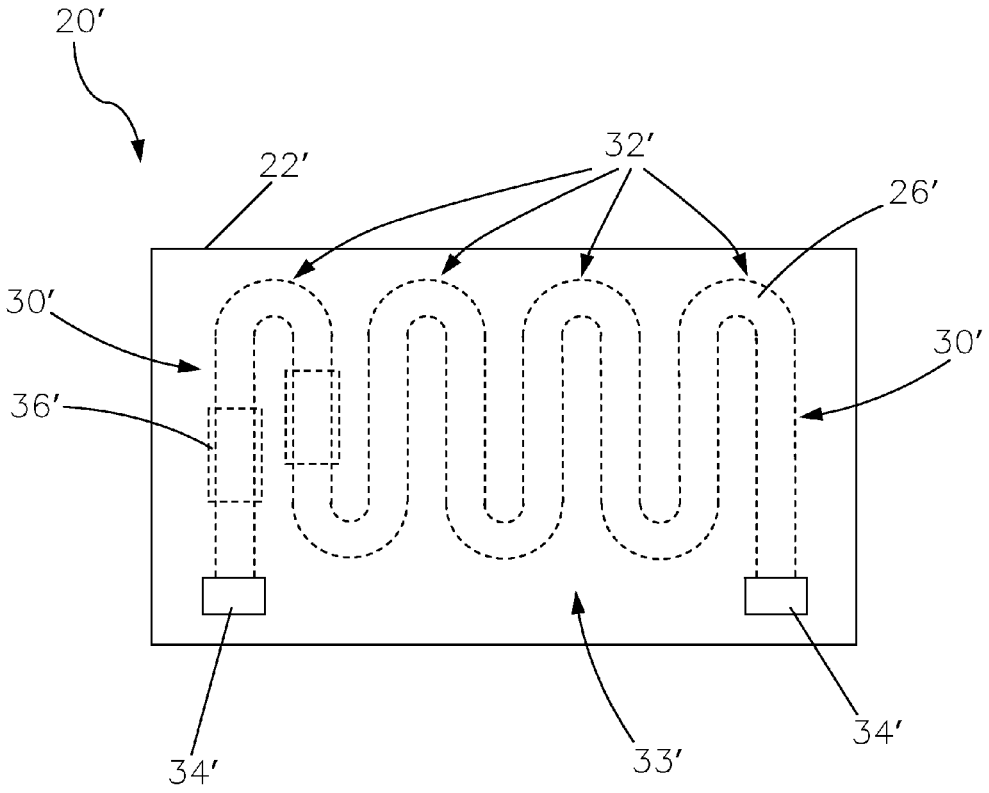
FIG. 11 is a plan view of an alternate form of a layered heater having conductive overlays along straight portions of the resistive circuit pattern and constructed in accordance with the principles of the present disclosure.
Figure 12:
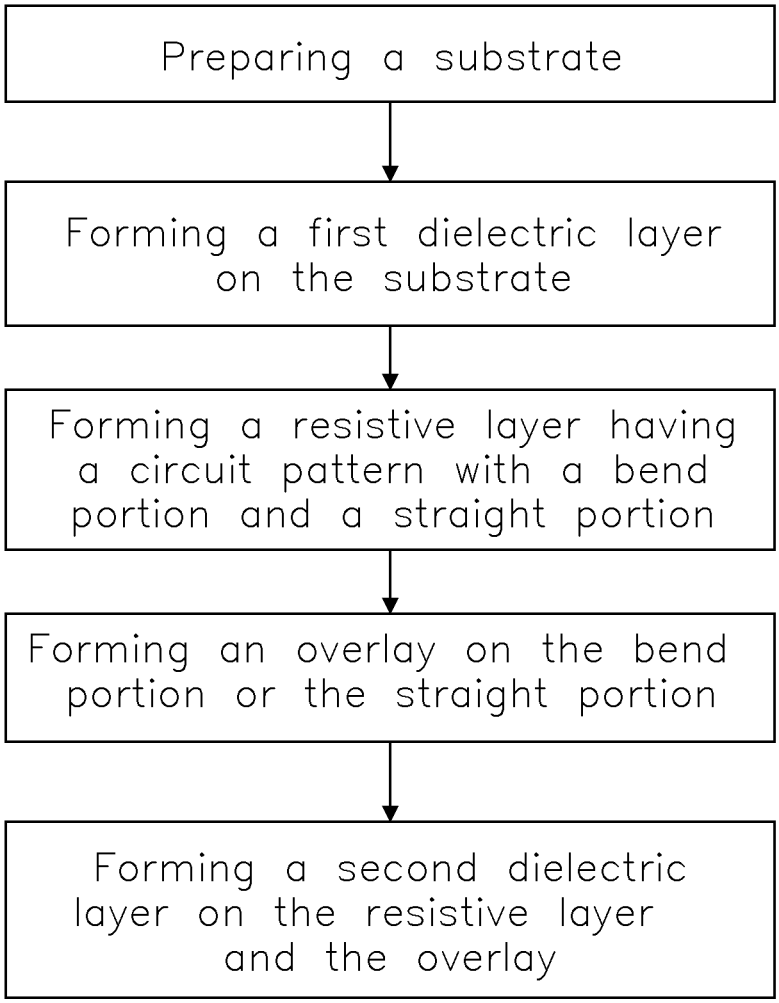
FIG. 12 is a schematic flow diagram of a method of manufacturing a layered heater with conductive overlays in accordance with the principles of the present disclosure.

It should also be understood that the conductive overlays 36 need not necessarily be formed exclusively over the bend portions 32. The conductive overlays 36 may be formed over any portion of the resistive circuit pattern 33 according to specific heater needs while remaining within the scope of the present disclosure. By way of example, as shown in FIG. 11, yet another form of a layered heater in accordance with the principles of the present invention is illustrated and generally indicated by reference numeral 20'. The layered heater 20' comprises a resistive circuit pattern 33' formed over the substrate 22' substantially as previously described, and conductive overlays 36' formed over straight portions 30' rather than over the bend portions 32'. As such, the conductive overlays 36' are disposed over a continuous portion of the resistive circuit pattern 33', similar to the bend portions 32', such that the current continues to flow within the resistive circuit pattern 33' both before and after passing through the conductive overlays 36'. Being disposed over a continuous portion of the resistive circuit pattern 33' thus structurally distinguishes the conductive overlays 36' and 36 from the terminal pads 34' and 34, respectively Referring to FIG. 12, a method of manufacturing the layered heater 20 in accordance with the present disclosure is now described in further detail. The resistive layer 26 may be formed by any number of layering processes, such as thick film, thin film, thermal spray, sol-gel, and combinations thereof, among others. As used herein, the term "layering processes" should be construed to include processes that generate at least one functional layer (e.g., dielectric layer, resistive layer, among others), wherein the layer is formed through application or accumulation of a material to a substrate, target, or another layer using processes associated with thick film, thin film, thermal spraying, or sol-gel, among others. These processes are also referred to as "layering processes."

The resistive layer 26 is typically formed on a first dielectric layer 24, however, this dielectric layer 24 is optional depending on the application requirements. Accordingly, the resistive layer 26 may be formed directly on the substrate 22. After the resistive layer 26 is formed, a conductive material is formed on the bend portions 32 to form the overlays 36. A mask (not shown) having a cutout corresponding to the areas where the overlays 36 are to be formed is placed on the resistive layer 26 to expose only the bend portions 32. Next, applying a conductive material onto the bend portions 32 results in forming of the overlays 36 on the resistive layer 26. Applying the conductive material onto the bend portions 32 can be achieved by layering processes, such as thick film, thin film, thermal spray, and sol-gel, among others. Thereafter, a second dielectric layer 28 is optionally formed over the resistive layer 26 and the conductive overlays 36 to achieve a layered heater 20 that compensates for current crowding.

Figure 13:
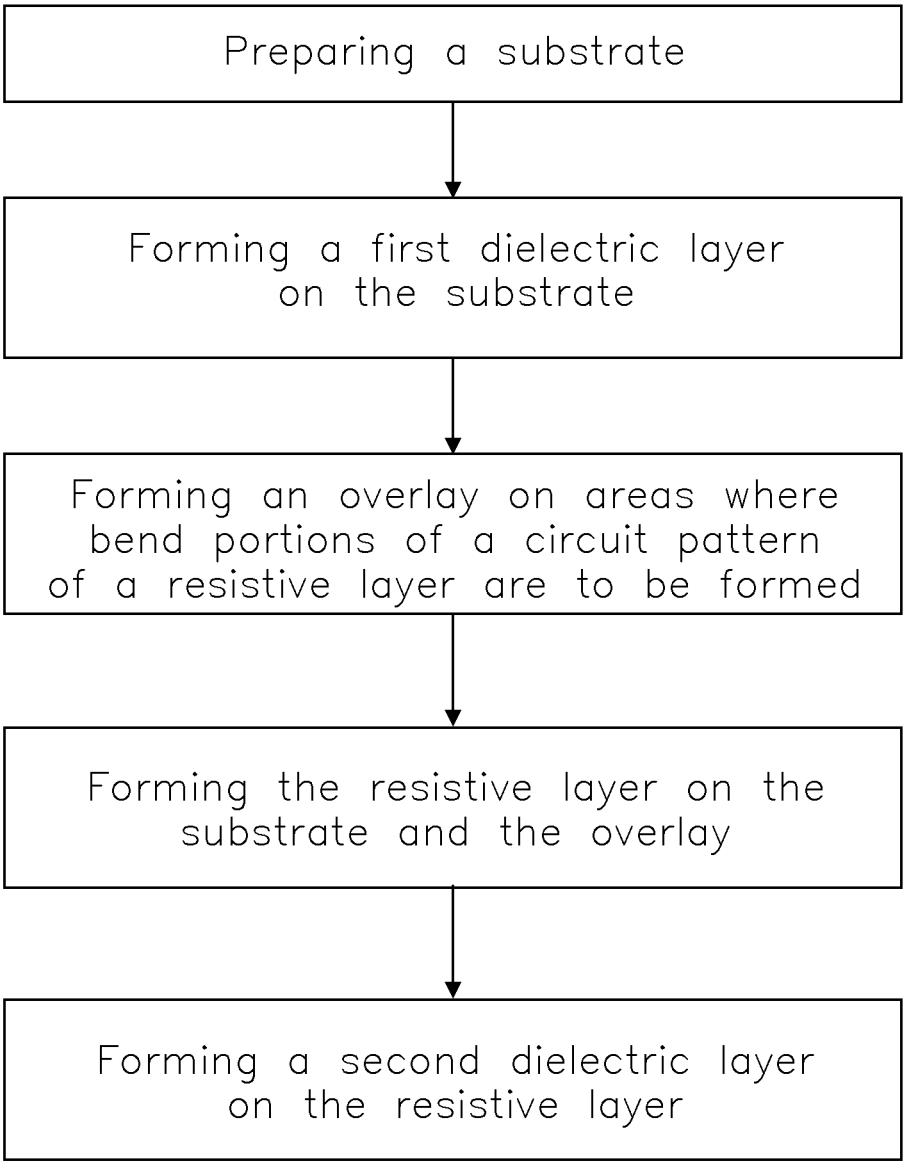
FIG. 13 is a schematic flow diagram of another method of manufacturing a layered heater with conductive overlays in accordance with the principles of the present disclosure.

According to another method of the present disclosure as shown in FIG. 13, the overlays 36 are formed before the resistive layer 26 is formed. The process is similar to the method described in connection with FIG. 12, except that after the first dielectric layer 24 is formed on the substrate 22, (if a first dielectric layer 24 is used), a conductive overlay 36 is formed on the areas where bend portions 32 of the electric circuit of the resistive layer 26 are to be formed. After the overlays 36 are formed, a resistive material is formed on the substrate 22 or the first dielectric layer 24, including the areas where the overlays 36 have been formed, to form a resistive layer 26. In this form, the overlays 36 are below the resistive layer 26 rather than over as previously described, which is illustrated in FIG. 5.

Figure 14:
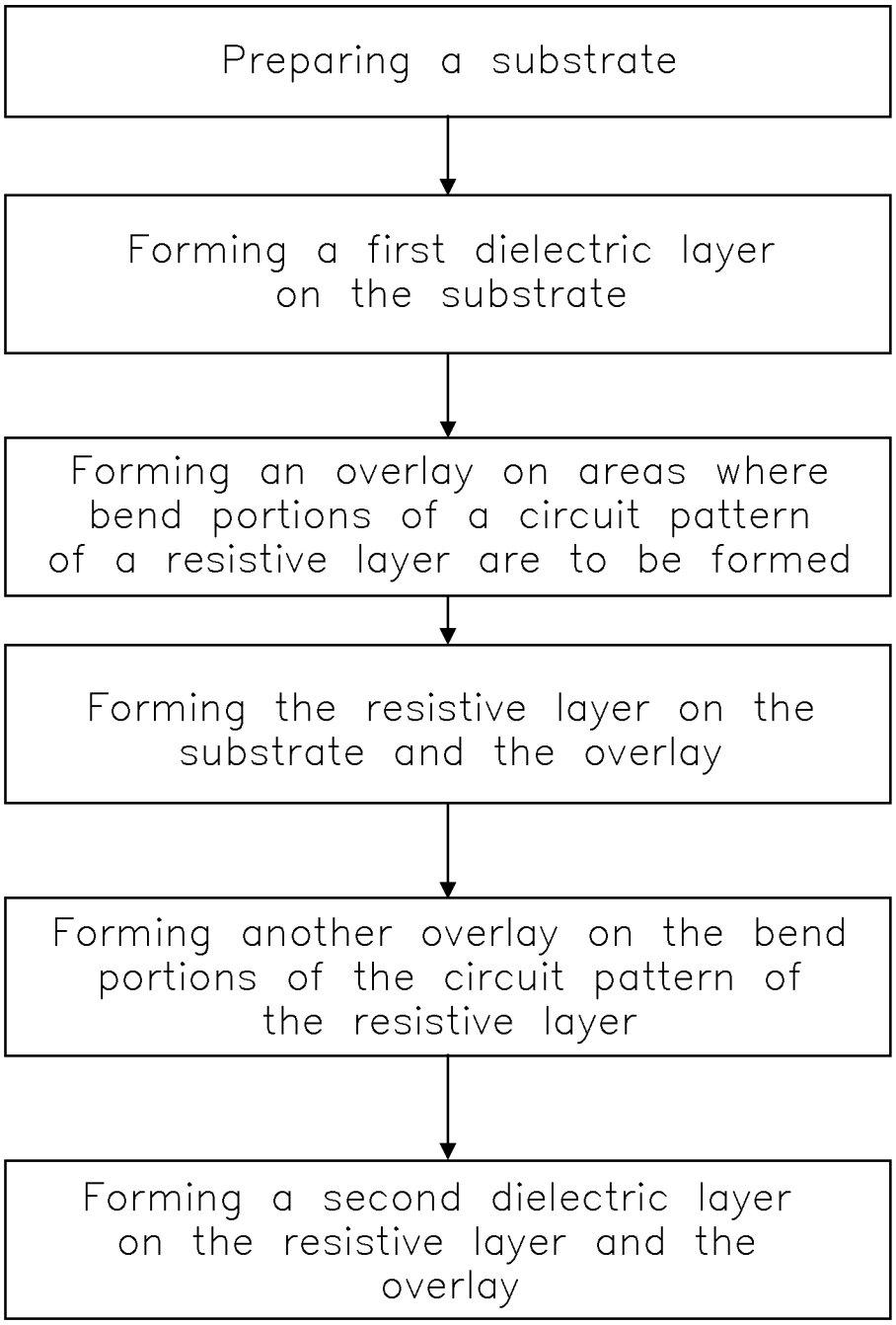
FIG. 14 is a schematic flow diagram of another method of manufacturing a layered heater with conductive overlays in accordance with the principles of the present disclosure.

Yet another method of the present disclosure is shown in FIG. 14, where the overlays are formed on both of the top surface 38 and the bottom surface 40 of the bend portions 32. This method is similar to the method described in connection with FIG. 13, except that after the resistive layer 26 is formed over the first overlays 36, a conductive material is formed on the bend portions 32 of the resistive layer 26 to form additional overlays 36 on the bend portions 32. Accordingly, overlays 36 are disposed both below and above the resistive layer 26, which is illustrated in FIG. 6.

It should be noted that while the resistive circuit pattern in the illustrative embodiment has been described to be a serpentine pattern, the principles of the present disclosure can be applied to a layered heater having a resistive circuit pattern other than a serpentine pattern as long as the circuit pattern includes at least one bend portion, or a portion that includes a change in direction, where current crowding typically occurs, or in other areas of a circuit pattern as set forth herein.

Figure 15:
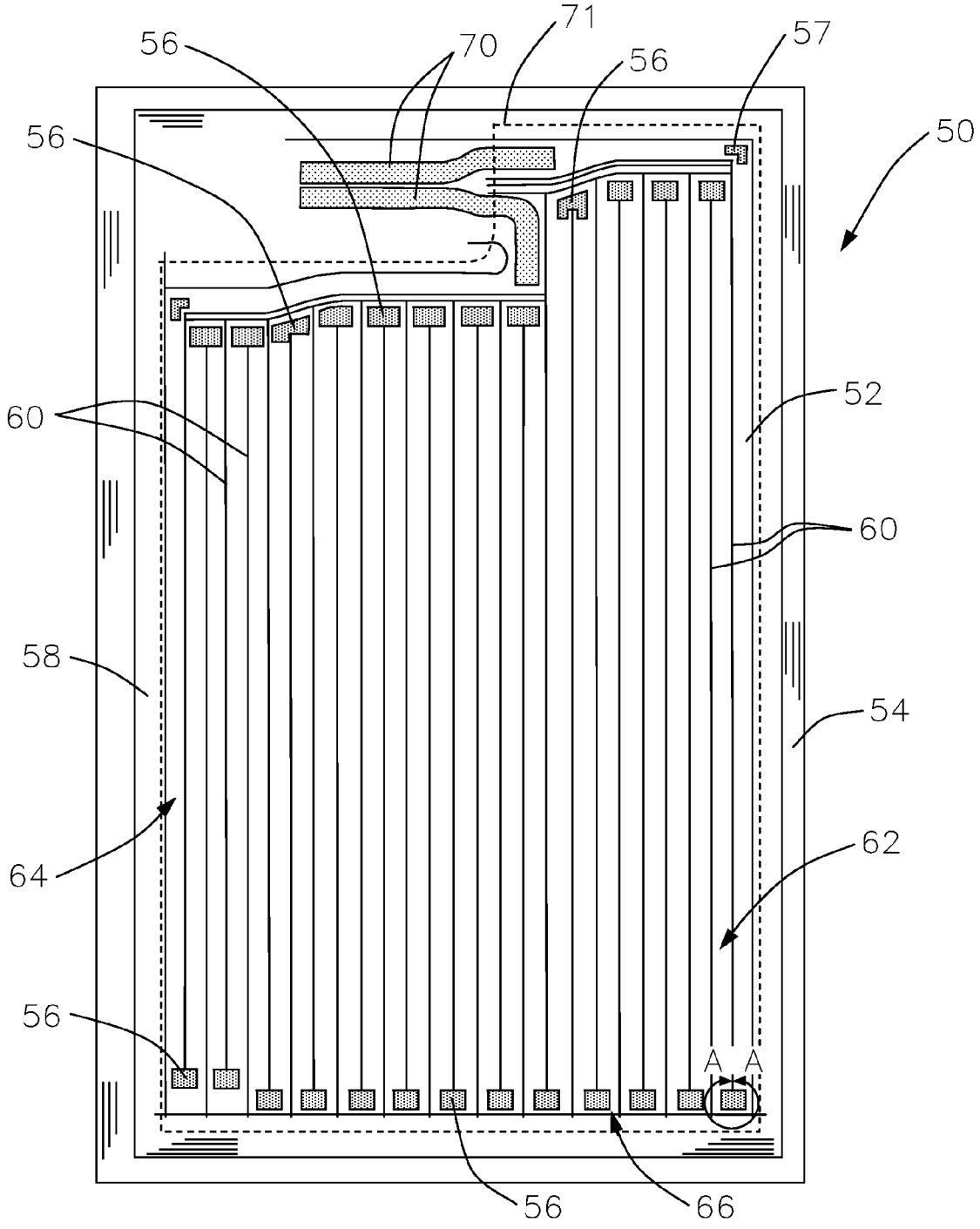
FIG. 15 is a plan view of a layered heater constructed in accordance with a method employing single cuts according to the principles of the present disclosure.
Figure 16:
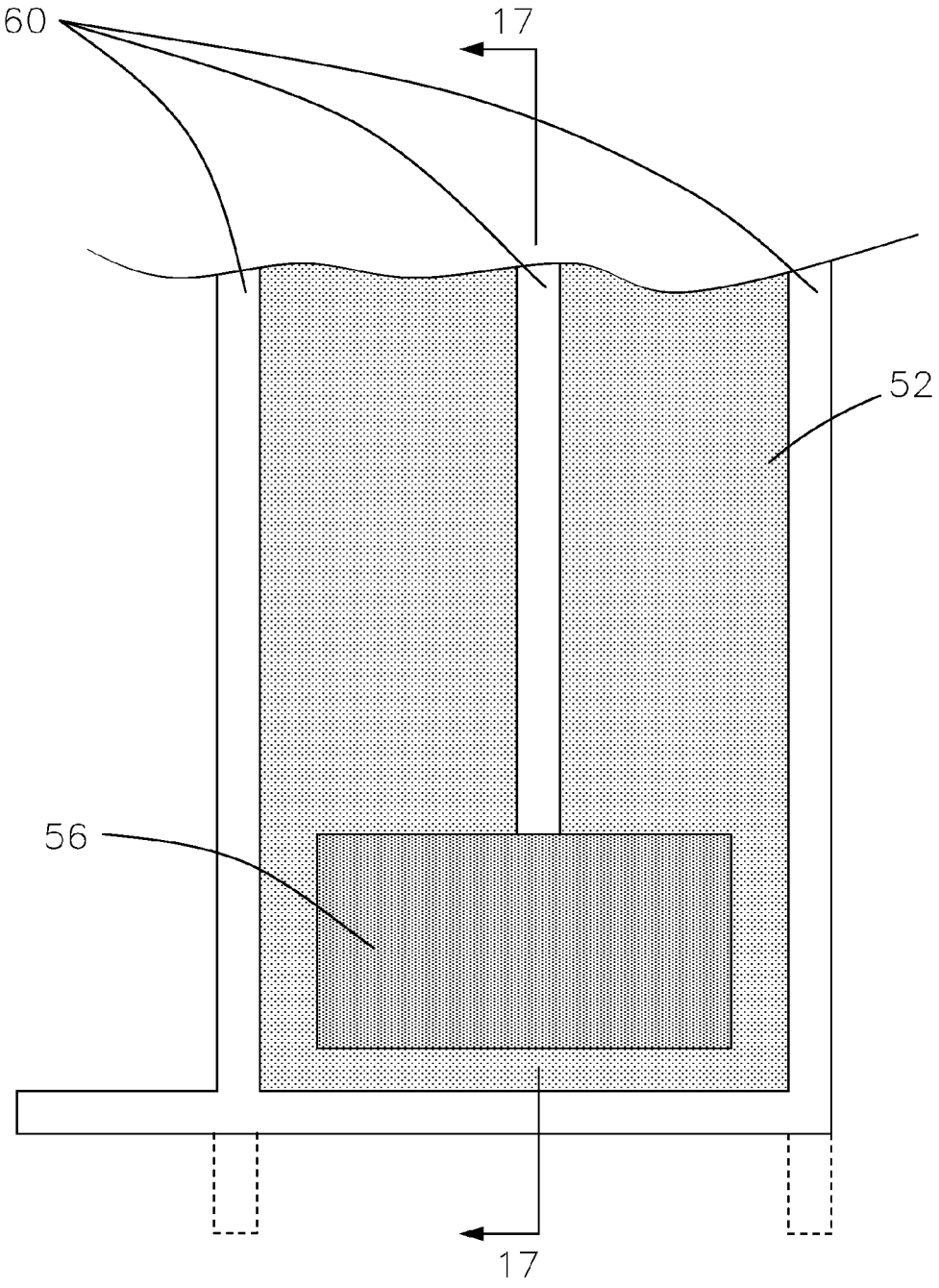
FIG. 16 is an enlarged view, taken within Detail A-A of FIG. 15, illustrating the single cut in accordance with the principles of the present disclosure.

Referring to FIGS. 15 and 16, yet another form of a layered heater constructed in accordance with the teachings of the present disclosure is illustrated and generally indicated by reference numeral 50. The layered heater 50 comprises a continuous resistive layer 52 formed over a substrate 54 and a plurality of conductive overlays 56 disposed in predetermined areas of the resistive layer 52. In one form, a dielectric layer 58 is first formed over the substrate 54, and then the continuous resistive layer 52 is formed over the dielectric layer 58. Alternately, the resistive layer 52 may be formed directly over the substrate 54 without the dielectric layer 58, for some applications. Additionally, the conductive overlays 56 may be formed below, above, or below and above the resistive layer 52 as previously described. Preferably, the continuous resistive layer 52, the conductive overlays 56, and the dielectric layer 58 are formed using a thermal spray process, and more specifically, a plasma spray method. It should be understood, however, that other layered processes as set forth herein may also be employed. Accordingly, the specific construction and layered processes as illustrated and described should not be construed as limiting the scope of the present disclosure.

As further shown, a plurality of single cuts 60 extend between the plurality of corresponding conductive overlays 56 to form a resistive circuit pattern 62. More specifically, the resistive circuit pattern 62 comprises straight portions 64 and bend portions 66 in one form of the present disclosure. Preferably, the single cuts 60 are created using a laser, however, other methods of material removal such as water jet or other abrasion techniques may be employed while remaining within the scope of the present disclosure. By way of example, the dielectric layer 58 is formed over the substrate 54, the conductive overlays 56 are then formed in predetermined areas as shown, and then the continuous resistive layer 52 is formed over the dielectric layer 58 and the conductive overlays 56.

Figure 17:
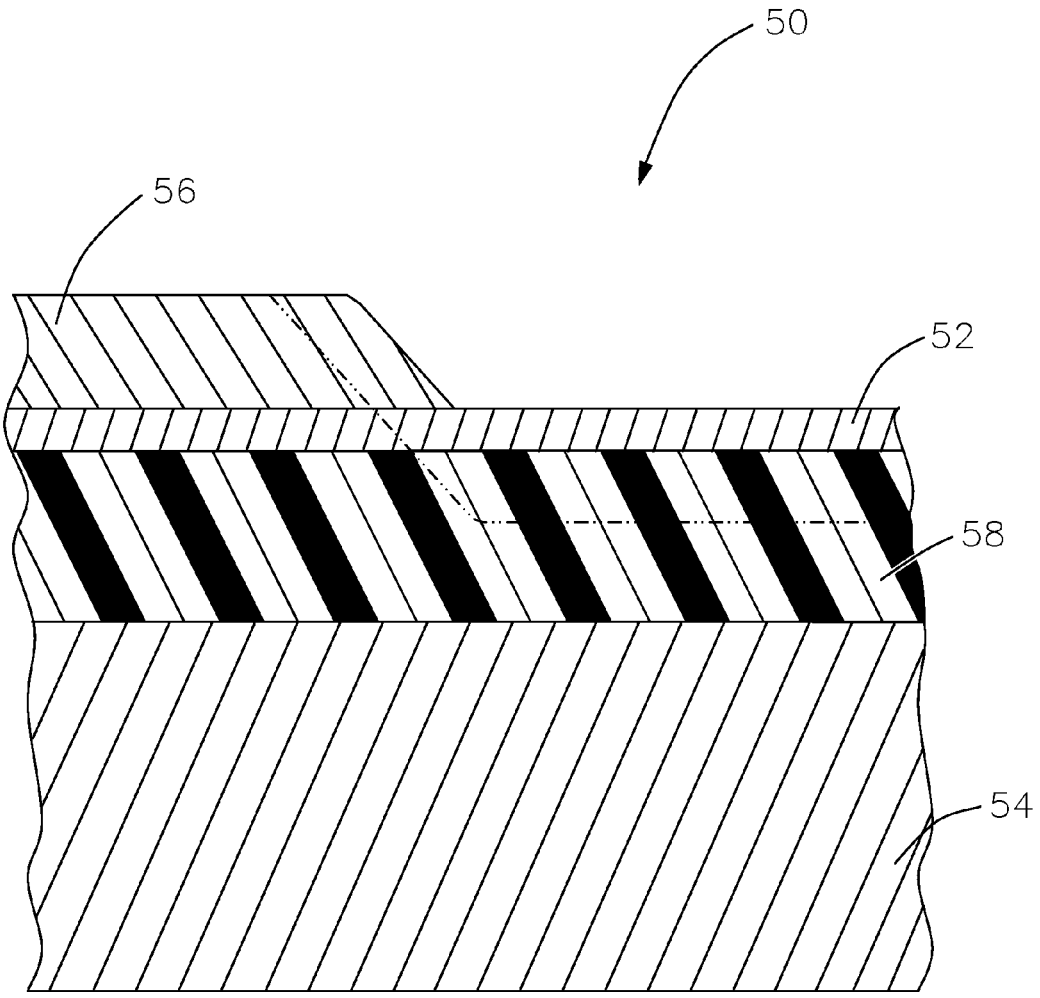
FIG. 17 is a cross sectional view, taken along line 17-17 of FIG. 16, illustrated the single cut in accordance with the principles of the present disclosure.

As shown in FIGS. 16 and 17, the single cuts 60 (shown phantom in FIG. 17) extend all the way through the continuous resistive layer 52 and longitudinally into a portion of the corresponding conductive overlay 56. As such, no portion of the continuous resistive layer 52 is present outside the conductive overlay 56 proximate the end of the single cuts 60, thus reducing the presence of "hot spots" local to this area. If there were any portion of the continuous resistive layer 52 present at the end of the single cuts 60 and outside the conductive overlay 56 (shown by the dashed portion 68 in FIG. 16), this portion would not have a conductive overlay 56 to reduce current crowding as previously described. Therefore, carrying the single cuts 60 into at least a portion of the conductive overlays 56 eliminates this possibility.

As further shown in FIG. 15, termination pads 70 are formed in predetermined areas and are in contact with the continuous resistive layer 52 to provide requisite power to the layered heater 50. Accordingly, lead wires (not shown) are connected to these termination pads 70, wherein the lead wires are connected to a power source (not shown). Preferably, another dielectric layer 71 (shown dashed) is formed over the continuous resistive layer 52 for both thermal and electrical isolation to the outside environment.

As shown in FIG. 15, the conductive overlays 56 may take on a variety of shapes, depending on the desired shape of the circuit pattern, and more specifically, the bend portions 66. By way of example, many of the conductive overlays 56 define a relatively square shape, while the overlays 57 disposed proximate the corners of the substrate 54 define an "L" shape. Accordingly, it should be understood that these specific shapes and sizes for the conductive overlays 56 and 57 are merely exemplary and should not be construed as limiting the scope of the present disclosure.

With the continuous resistive layer 52 and the use of single cuts 60 as described herein, the layered heater 50 advantageously provides a greater substrate watt density for a given trace watt density due to the increased trace percent coverage, thus resulting in improved heating characteristics.

Figure 18:
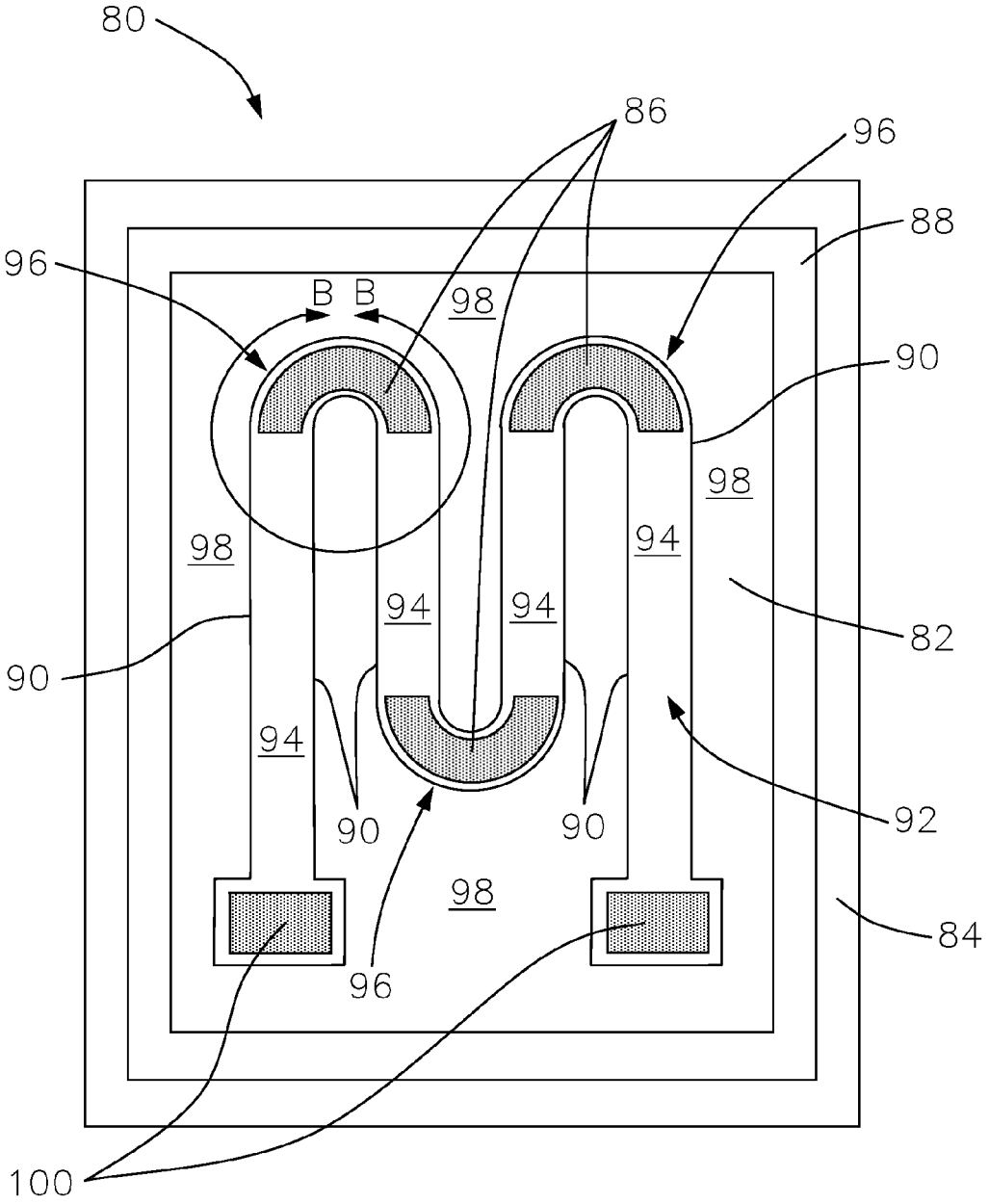
FIG. 18 is a plan view of a layered heater constructed in accordance with a method employing parallel cuts according to the principles of the present disclosure.
Figure 19:
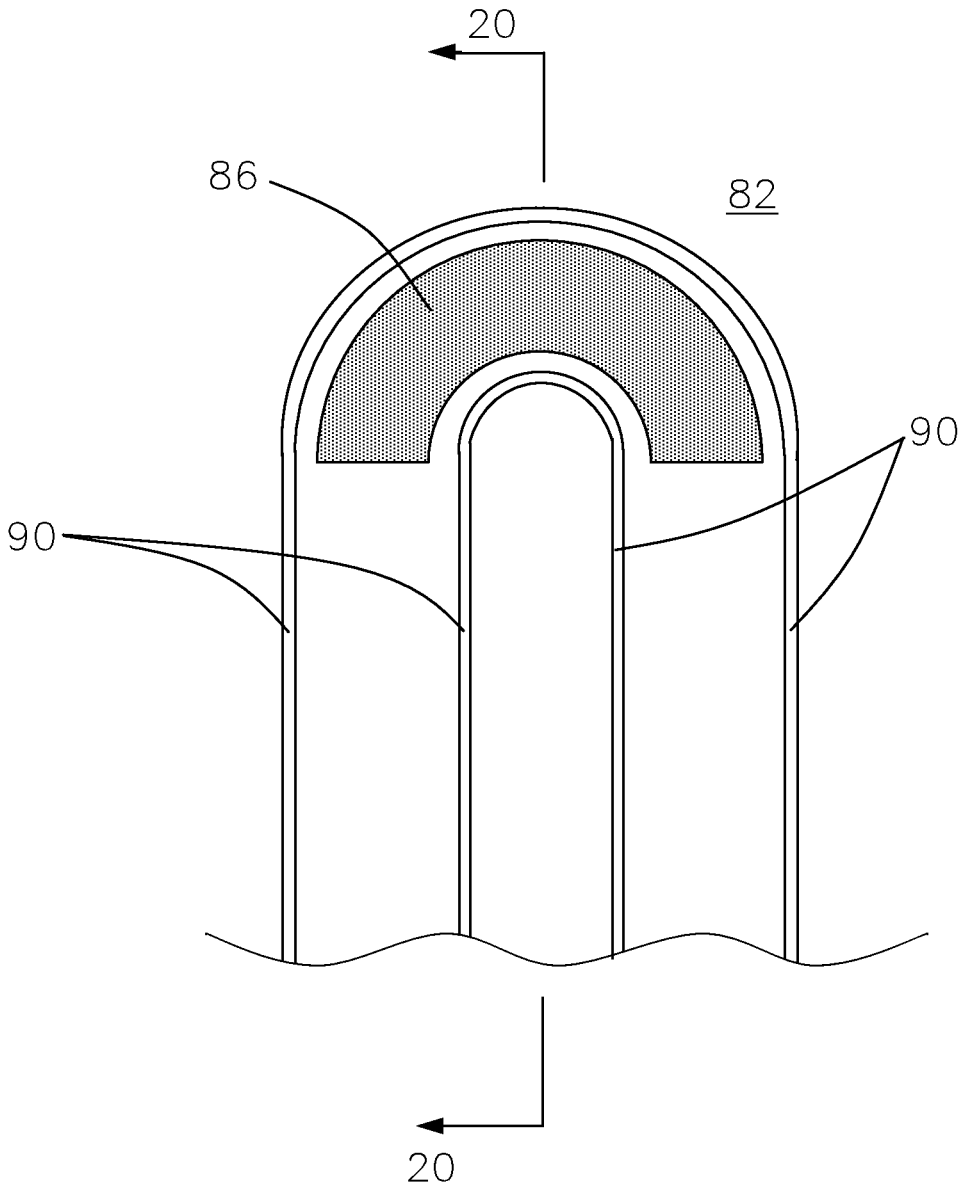
FIG. 19 is an enlarged view, taken within Detail B-B of FIG. 18, illustrating the parallel cuts in accordance with the principles of the present disclosure.

Referring now to FIGS. 18-19, yet another layered heater is illustrated and generally indicated by reference numeral 80. The layered heater 80 comprises a continuous resistive layer 82 formed over a substrate 84 and a plurality of conductive overlays 86 disposed in predetermined areas of the resistive layer 82. In one form, a dielectric layer 88 is first formed over the substrate 84, and then the continuous resistive layer 82 is formed over the dielectric layer 88. Alternately, the resistive layer 82 may be formed directly over the substrate 84 without the dielectric layer 88, for some applications. Additionally, the conductive overlays 86 may be formed below, above, or below and above the resistive layer 82 as previously described. Preferably, the continuous resistive layer 82, the conductive overlays 86, and the dielectric layer 88 are formed using a thermal spray method, and more specifically, either wire-arc spraying or wire-flame spraying. It should be understood, however, that other layered processes as set forth herein may be employed. Accordingly, the specific construction and layered processes as illustrated and described should not be construed as limiting the scope of the present disclosure.

As further shown, a plurality of parallel cuts 90 (best shown in FIG. 19) extend between and around the plurality of corresponding conductive overlays 86 to form a resistive circuit pattern 92, and more specifically, the straight portions 94 and the bend portions 96. Preferably, the parallel cuts 90 are created using a laser, however, other methods of material removal such as water jet or other abrasion techniques may be employed while remaining within the scope of the present disclosure. By way of example, the dielectric layer 88 is formed over the substrate 84, the conductive overlays 86 are then formed in predetermined areas as shown, and then the continuous resistive layer 82 is formed over the dielectric layer 88 and the conductive overlays 86.

As further shown, termination pads 100 are formed in predetermined areas and are in contact with the continuous resistive layer 82 to provide requisite power to the layered heater 80. Accordingly, lead wires (not shown) are connected to these termination pads 100, wherein the lead wires are connected to a power source (not shown). Preferably, another dielectric layer (not shown) is formed over the continuous resistive layer 82 for both thermal and electrical isolation to the outside environment.

Since the resistive layer 82 is continuous across substantially the entire substrate 84, an intermediate area 98 of the resistive layer 82 is formed outside the resistive circuit pattern 92. This intermediate area 98 is not electrically "live" since the termination pads 100 are connected with the resistive circuit pattern 92 and the parallel cuts 90 bound the resistive circuit pattern 92.

Figure 20:
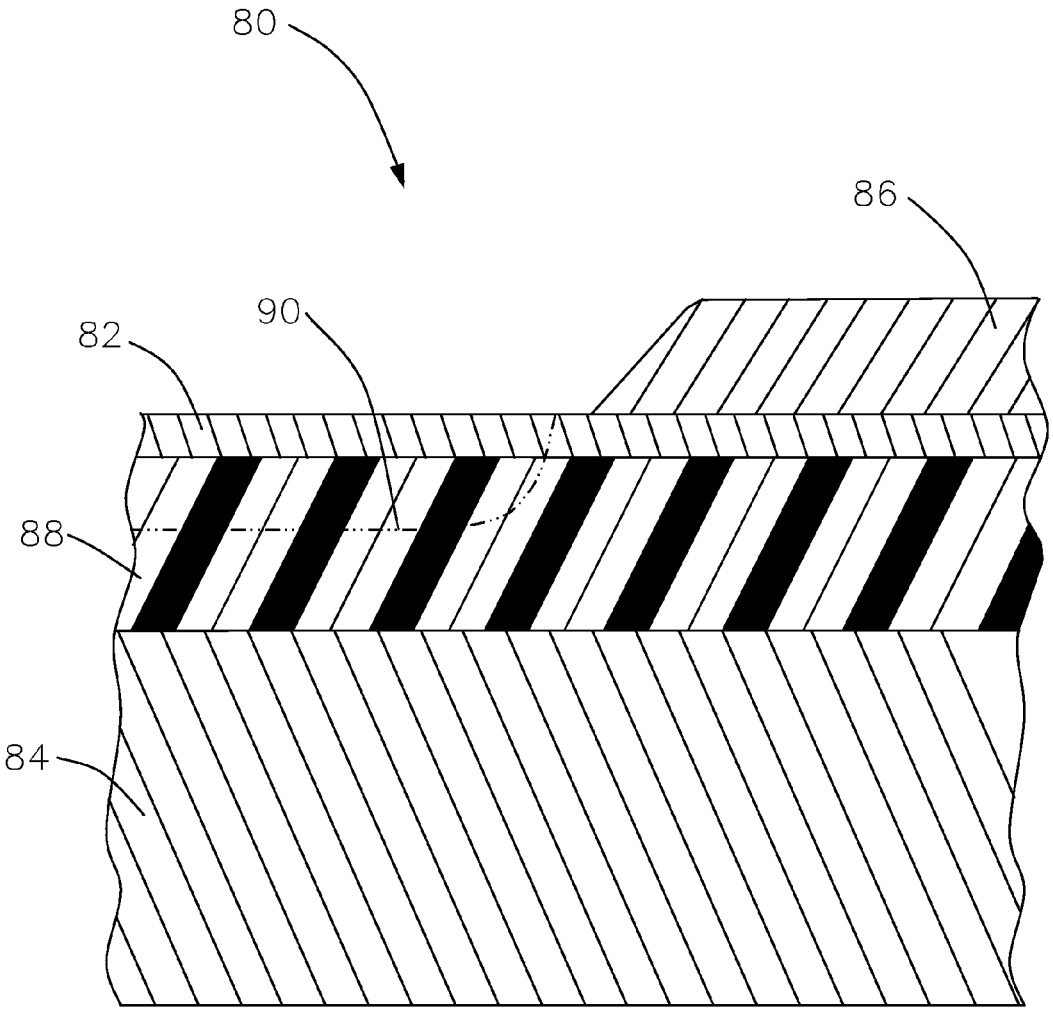
FIG. 20 is a cross sectional view, taken along line 20-20 of FIG. 19, illustrating the parallel cuts in accordance with the principles of the present disclosure.

As shown in FIGS. 19 and 20, the parallel cuts 90 (shown phantom in FIG. 20) extend all the way through the continuous resistive layer 82 and do not extend longitudinally into any portion of the corresponding conductive overlays 86. The parallel cuts 90 preferably maintain separation between the resistive circuit pattern 92 and the intermediate area 98 so that the intermediate area 98 does not become electrically "live." As such, the parallel cuts 90 cannot extend into the conductive overlays 86, otherwise, the intermediate areas 98 will come into electrical contact with the conductive overlays 86 and short out the resistive circuit pattern 92.

It should be understood that the description herein is merely exemplary in nature and, thus, variations that do not depart from the gist of the disclosure are intended to be within the scope of the claimed invention. Such variations are not to be regarded as a departure from the spirit and scope of the disclosure.

What is claimed is:

1. A layered heater comprising:

a substrate;

a dielectric layer formed on the substrate;

a continuous resistive layer formed on the dielectric layer, the continuous resistive layer comprising a conductive material separated into an intermediate area and a resistive circuit pattern by a plurality of cuts that extend all the way through the continuous resistive layer, the intermediate area being a part of the continuous resistive layer, the resistive circuit pattern having at least one bend portion, the bend portion having a top surface and a bottom surface;

termination pads electrically connected to the resistive circuit pattern; the intermediate area being electrically inactive;

a conductive overlay disposed on at least one of the top surface and the bottom surface of the bend portion;

wherein the plurality of cuts do not extend longitudinally into the conductive overlay such that the intermediate area does not come into electrical contact with the conductive overlay; and a second dielectric layer formed over the resistive layer and the conductive overlay.

2. The layered heater according to claim 1, wherein the overlay is formed on the top surface of the bend portion.

3. The layered heater according to claim 1, wherein the overlay is formed on the bottom surface of the bend portion.

4. The layered heater according to claim 1, wherein the overlay is formed on the top surface and the bottom surface of the bend portion.

5. The layered heater according to claim 1, wherein the overlay is made of the same material as the resistive layer.

6. The layered heater according to claim 1, wherein the overlay is made of a material different from that of the resistive layer.

7. The layered heater according to claim 6, wherein the overlay is made of a material comprising 30% Ag, 38% Cu, and 32% Zn.

8. The layered heater according to claim 1, wherein the overlay has a variable thickness.

9. The layered heater according to claim 1, wherein the each of the dielectric layer, the continuous resistive layer, the conductive overlay, and the second dielectric layer are formed by a thermal spray process.

10. The layered heater according to claim 1, wherein the plurality of cuts are formed by a laser.

11. The layered heater according to claim 1, wherein the plurality of cuts extend through the continuous resistive layer between the conductive overlay and longitudinally into a portion of the conductive overlay.

* * * * *